US006442366B1

(12) United States Patent
Hartley et al.

(10) Patent No.: US 6,442,366 B1
(45) Date of Patent: Aug. 27, 2002

(54) EXTERNAL RADIANT HEATER FOR FUSER MEMBERS AND METHOD OF MAKING SAME

(75) Inventors: Heather Hartley, Cheltenham; Patrick Shaw, Leighton Buzzard, both of (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/769,660

(22) Filed: Jan. 25, 2001

(51) Int. Cl.[7] ..... G03G 15/20
(52) U.S. Cl. ..... 399/336; 219/216; 399/333
(58) Field of Search ..... 399/330, 333, 399/335, 336, 337; 219/216, 469, 470

(56) References Cited

U.S. PATENT DOCUMENTS 3,725,639 A * 4/1973 Seil et al. ..... 219/469 X
4,009,953 A * 3/1977 Ravizza et al. ..... 399/336 X
4,071,735 A 1/1978 Moser ..... 219/216
4,114,021 A * 9/1978 Nishide et al. ..... 219/469 X
4,266,115 A * 5/1981 Dannatt ..... 219/469 X
4,395,109 A * 7/1983 Nakajima et al. ..... 219/469 X
4,518,845 A * 5/1985 Svendsen ..... 219/469 X
6,049,692 A * 4/2000 Hwang ..... 399/336 X
6,061,545 A 5/2000 Cerrah ..... 399/330
6,223,017 B1 * 4/2001 Akutsu et al. ..... 399/335 X

* cited by examiner

*Primary Examiner*—Fred L Braun
(74) *Attorney, Agent, or Firm*—Oliff & Berridge, PLC; Eugene Palazzo

(57) ABSTRACT

An external heating source for a fuser member used in an image forming system includes a substrate and a ceramic-containing coating. The surface of the fuser member is heated with thermal radiation generated by an external heating source located near the surface of the fuser member. Heat is generated by a resistive radiator on the surface of the external heating source which includes a ceramic-containing material having a high resistance, such as a transition metal oxide. The external heating source can further include at least one temperature sensor for achieving and maintaining a desired temperature on the surface of the fuser member. A method of manufacturing the external heating source is also described.

20 Claims, 5 Drawing Sheets

EXTERNAL RADIANT HEATER FOR FUSER MEMBERS AND METHOD OF MAKING SAME

BACKGROUND OF THE INVENTION

This invention relates to a fusing system in an image forming system for fixing a toned image to a support member. More particularly, this invention relates to an external heating source for providing radiant thermal energy to a fuser member surface.

In a typical image forming system, a light image of an original to be copied is recorded in the form of an electrostatic latent image upon a photosensitive imaging member. The latent image is subsequently rendered visible by the application of electroscopic thermoplastic resin particles, which are commonly referred to as toner. The visible toned image is then in a loose powdered form and can be easily disturbed or destroyed. The toned image is usually fixed or fused upon a support sheet such as plain paper.

The use of thermal energy for fixing developed toned images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes it to be firmly bonded to the support.

Typically, toner particles are fused to a print substrate by heating to a temperature of between about 90° C. to about 160° C. or higher, depending upon the softening range of the particular resin used in the toner. It is not desirable, however, to raise the temperature of the substrate substantially higher than about 200° C. because of the tendency of the substrate to discolor at such elevated temperatures, particularly when the substrate is paper.

Several approaches to thermal fusing of electroscopic toned images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles generally takes place when the proper combination of heat, pressure and contact time is provided. The balancing of these parameters to bring about the fusing of the toner particles is well known in the art, and they can be adjusted to suit particular machines, process conditions, and printing substrates.

During operation of a fusing system in which heat is applied to cause thermal fusing of the toner particles onto a support, both the toner image and the support are passed through a nip formed between the roll pair, or plate, and/or belt members. The concurrent transfer of heat and the application of pressure in the nip effects the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus, increasing the background or interfering with the material being copied. The so called "hot offset" occurs when the temperature of the toner is raised to a point where the toner particles liquefy and a splitting of the molten toner takes place during the fusing operation with a portion remaining on the fuser member.

The hot offset temperature or degradation of the hot offset temperature is a measure of the release property of the fuser roll, and accordingly it is desired to provide a fusing surface that has a low surface energy to provide the necessary release. To ensure and maintain good release properties of the fuser roll, it has become customary to apply release agents to the fuser members to ensure that the toner is completely released from the fuser roll during the fusing operation. Typically, these materials are applied as thin films of, for example, silicone oils to prevent toner offset.

A feature common to most of the prior art fuser members is that the source of the heat energy for the fusing operation is generally in the form of a quartz lamp positioned in the core of a fuser member. In such a configuration, the heat must be conducted from the core of the fuser member, through the various layers of materials comprising the fuser member, to the surface of the fuser member for fusing the toned image to the copy substrate. To obtain the proper higher fusing temperature needed for fusing at the surface of such a fusing member, the temperatures at the various layers or points within the fuser member must be substantially higher. Since heat must be transmitted from the source in the core of the fuser member to its surface, it takes an appreciable amount of time before the surface of the fusing member is warmed up to the fusing temperature and thus ready for operations. This delay in readiness of the machine to fuse toned images, or the warm-up time, is accentuated by the fact that such fuser members are generally made of elastomeric or other polymeric materials, which are generally poor conductors of heat.

To solve some of the above problems that occur with internally heated fuser members, an external heating source has been used. This external heating source is associated with the fusing member so as to provide heat to the surface of the fusing member.

U.S. Pat. No. 4,071,735 discloses an externally heated roll fuser, in which the heating element heats the fuser roll at the same time preheats the toned image to be fused. The fuser roll of this patent is made of a metallic core with a layer of heat insulating silicone rubber thereon.

U.S. Pat. No. 6,061,545 discloses an external heating element for a fusing system having a heat source, a substrate and an outer fluoropolymer layer with a fluoropolymer and a conductive filler.

Although external heating elements provide benefits to image fusing, problems with the use of external heating sources persist. The external heating sources in the prior art are primarily high temperature (2000° C.) radiant heat line sources (lamps) providing the necessary heat energy to a targeted location on the fuser member surface. The cost, heater element dimensions and the nature of the heat source restrict the number of components and dictate that heat must be applied to a limited portion of a fuser member surface. Consequently, this necessitates high heat fluxed and elevated temperatures to transfer heat energy to a fuser member in the limited time that is available as a fuser member rotates past an external heater. A particular disadvantage to the external heating elements for fuser members of the prior art is non-uniform heating of a fuser roll surface. While one location of the fuser member surface receives a sufficient amount of heat, other locations may receive too much or too little heat. Non-uniform heating of a fuser roll surface results in inconsistent heating of the toner particles, which then results in irregularities and inconsistencies in the final image. This arrangement is also susceptible to paper or substrate fires in the event of a fuser wrap, which occurs when paper or substrate adheres to the fuser member surface and is carried to the location where heat is applied to the surface. The temperature of the heating element is sufficient to ignite the paper or substrate under either direct contact or prolonged exposure. An additional disadvantage of prior external heating elements is difficulty in controlling the temperature on the surface of the fuser member. An unsuitable temperature causes incomplete fusion of the image to the print substrate, discoloration of the print substrate and other undesirable effects.

SUMMARY OF THE PRESENT INVENTION

The present invention provides an external heating source for a fuser member used in an image forming system. According to one practice of the invention, the surface of the fuser member is heated with thermal radiation generated by an external heating source located near the surface of the fuser member. Heat is generated by a resistive radiator on the surface of the external heating source, comprised of a ceramic-containing material having a high resistance, such as a transition metal oxide.

The present invention provides an external heating source for a fuser member, wherein high quality prints and/or copies are produced. Particularly, the invention provides an external heating source demonstrating improved temperature control and uniformity in heating a fuser member. The external heating source of the present invention maintains an ideal temperature throughout the surface of the fuser member for extended periods of time. As a result, proper fusion of a toned image to a print substrate is ensured, and a high-quality final image is consistently printed.

According to one aspect, the present invention provides a fusing system for fusing a toned image to a support sheet in an image forming system. The fusing system includes a fuser member and an external heating source for supplying thermal radiation to heat a surface of the fuser member. The external heating source includes a substrate and a ceramic-containing coating applied to an outer surface of the substrate.

According to another aspect, the present invention provides a method of heating a surface of a fuser member in an image forming system. The method comprises the steps of providing an external heating source comprising a substrate and a ceramic-containing coating, and supplying radiant thermal energy generated by the heating source to the fuser member.

According to still another aspect, the present invention provides a fusing system including a fuser member and an external heating source wherein the external heating source comprises a plurality of ceramic-containing coating strips formed on a substrate. In an alternate embodiment, the external heating source further comprises at least one temperature sensor, such as a thermistor, coupled to the ceramic-containing coating to control temperature on the surface of the fuser member.

DETAILED DESCRIPTION OF THE PRESENT INVENTION

According to embodiments of the present invention, an external heating source for fuser members in an image forming system is provided. In embodiments, an external heating source provides thermal radiation to the surface of a fuser member to effect fusion of an image to a print substrate. The term "fuser member" as used herein refers to fusing members suitable for use in an image forming system and which are adapted to fuse toner onto a recording medium, such as paper. The fuser members can include fusing rolls, belts, films, sheets and the like; donor members, including donor rolls, belts, films, sheets and the like; and pressure members, including pressure rolls, belts, films, sheets and the like; and other members useful in the fusing system of an image forming system. The fuser member of the present invention may be employed in a wide variety of machines or image forming systems and is not specifically limited in its application to the particular embodiment depicted herein. The term "external heating source" as used herein refers to a component suitable for use in a fusing system in an image forming system that supplies thermal energy to a fuser member surface and is contained outside of the fuser member.

Figure 1:
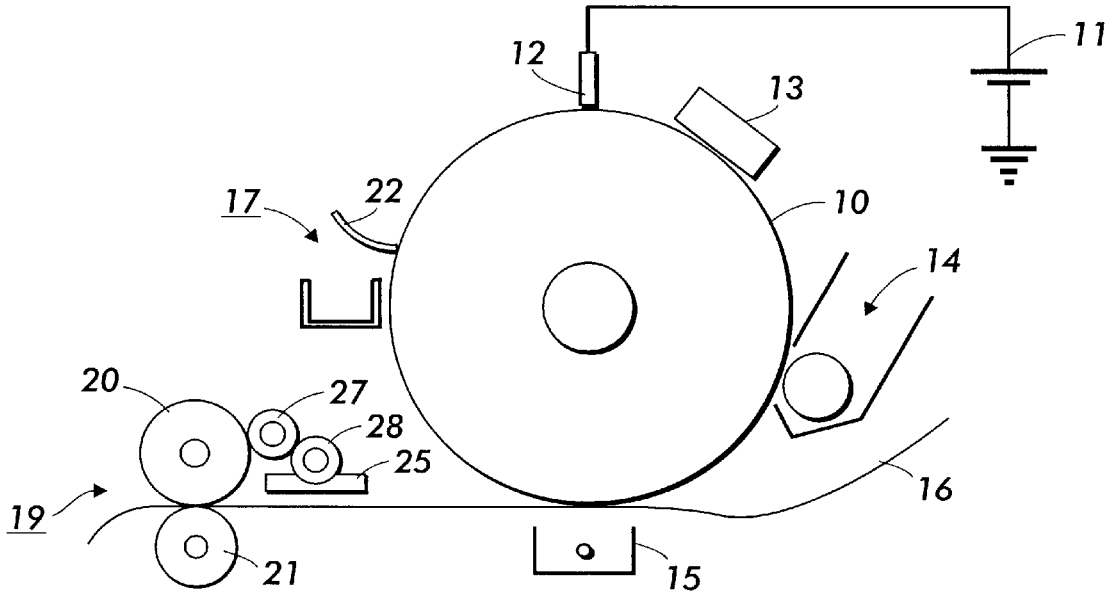
FIG.1 is a schematic view of an image forming system suitable for employing the external heating source and fusing system of the present invention.

Referring to FIG. 1, in a typical image forming system, a light image of an original to be copied is recorded in the form of an electrostatic latent image upon a photosensitive imaging member and the latent image is subsequently rendered visible by the application of electroscopic thermoplastic resin particles, which are commonly referred to as toner. Specifically, imaging member 10 is charged on its surface by a charger 12 to which a voltage has been supplied from power supply 11. The imaging member is then imagewise exposed to light from an optical system or an image input apparatus 13, such as a laser and light emitting diode, to form an electrostatic latent image thereon. Generally, the electrostatic latent image is developed by bringing a developer mixture from a developer station 14 into contact therewith. Development can be effected by use of a magnetic brush, powder cloud, or other known development process.

After the toner particles have been deposited on the imaging surface, they are transferred to a copy sheet 16 by a transfer system 15, which can effect transfer by pressure or electrostatic transfer techniques. Alternatively, the developed image can be transferred to an intermediate transfer member and subsequently transferred to a copy sheet.

After the transfer of the developed image is completed, copy sheet 16 advances to a fusing system 19, depicted in FIG. 1 as fusing and pressure rolls, wherein the developed image is fused to copy sheet 16 by passing copy sheet 16 between the fusing roll 20 and pressure roll 21, thereby forming a permanent image. Sump 25 contains a polymeric release agent, which may be a solid or liquid at room temperature, but is a fluid at operating temperatures. Two release agent delivery rolls 27 and 28 transport release agent to the surface of the fusing roll. Imaging member 10, subsequent to transfer, advances to cleaning station 17, where any toner left on imaging member 10 is cleaned therefrom by use of a blade 22 (as shown in FIG. 1), brush, or other cleaning apparatus.

Most conventional fuser members comprise a polymer layer formed upon a suitable base member, such as a hollow cylinder or core fabricated from any suitable metal, such as aluminum, anodized aluminum, steel, nickel, copper and the like. A suitable internal source of heat energy is disposed in the hollow portion of the fuser member. The heat source for the fusing operation is generally in the form of a quartz lamp positioned in the core of the fuser member. Heat generated by the heat source is conducted through the polymer layer and any intervening layers to reach the surface of the fuser member. In some systems, the pressure roll is also internally heated by one or more sources located centrally within the pressure roll.

Figure 2:
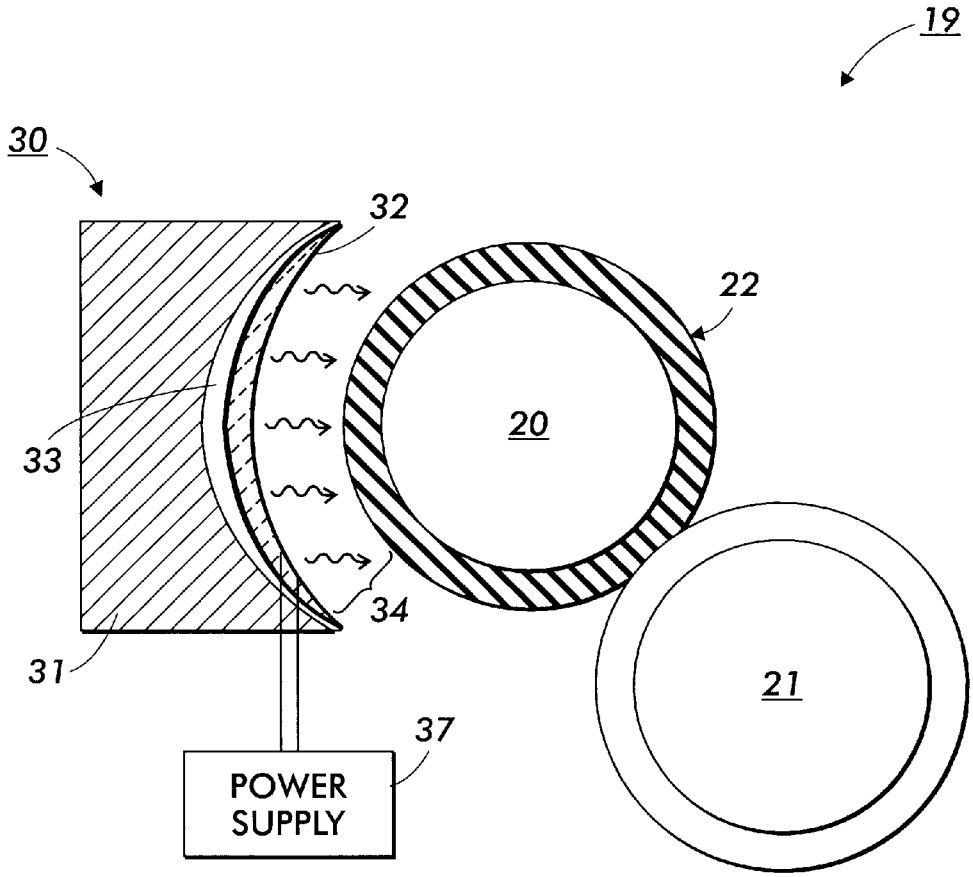
FIG. 2 illustrates a fusing system with an external heating source according to an illustrative embodiment of the present invention.

FIG. 2 depicts a fusing system according to an illustrative embodiment of the present invention. In the illustrated fusing system 19, an external heating source 30 replaces the internal lamp used to heat fuser members. Toner material is still heated by the fuser member. However, in the present invention, the surface of the fuser member 20 is heated directly by radiant thermal energy supplied from the external heating source 30. In embodiments of the present invention, the external heating source 30 can be formed of a profiled metal substrate 31 having a dielectric material 33 and a ceramic-containing coating 32 that generates heat. A surface of the metal substrate is initially coated with the dielectric material 33 prior to application of the ceramic-containing coating 32. The external heating source 30 radiates heat energy to the surface of the fuser member 20 via an air gap 34 located between the ceramic-containing coating 32, which functions as a heat-generating surface, and the surface of the fuser member 20.

The ceramic-containing coating 32 comprises any ceramic-containing material suitable for generating or radiating heat or thermal energy when supplied with power. "Ceramic" refers to any material composed primarily of inorganic, nonmetallic materials. In the illustrative embodiment of the invention, the ceramic-containing coating 32 comprises a ceramic material having a high resistance. According to one practice, the ceramic-containing coating comprises a cermet material (i.e. a transition metal oxide) consisting of an oxide matrix with unmelted alloy particles and voids. Suitable transition metal oxides include, but are not limited to, titanium oxide, titanium dioxide, nickel oxide, cerium oxide and the like.

The ceramic-containing coating 32 can be applied to the substrate 31 by any suitable method known in the art. Such methods include, but are not limited to, spraying, such as plasma spraying and thermal spraying, dipping, flow coating, casting or molding. According to one practice, the ceramic coating is applied to the substrate using a flame spraying manufacturing process. These processes are art known and need not be described further herein.

The external heating source 30 is coupled to a power source 37 for supplying power to the source, and specifically to the ceramic-containing coating 32. Any suitable power source capable of generating power, voltage or current may be employed, including an alternating current (AC) power supply and a direct current (DC) power supply. The external heating source 30 can optionally include a conductive layer (not shown) disposed between the dielectric layer and the ceramic coating, which provides a means of conducting current to the ceramic-containing coating to generate radiant heat for the fuser member. The conductive layer comprises any suitable material that is capable of carrying current, such as copper.

In FIG. 2, the power source 37 supplies a current to the ceramic-containing coating 32 of the external heating source 30. The ceramic-containing coating 32 generates heat energy when supplied with power, which is radiated from this heat-generating surface to the fuser member surface 22 as the fuser member 20 rotates past the external heating source 30. The surface 22, which is exposed to the radiant energy, heats up and then is rotated to contact a toned image on a support sheet. This heating causes the toner to flow into the fibers or pores of the support sheet to permanently fix the toned image thereto. Additionally, the external heating source 30 can also apply thermal energy to the support sheet to pre-heat the sheet before fusion of the toned image. The external heating source 30 can be adapted and arranged to heat the pressure roll 21 as well, which is beneficial in color applications.

In the illustrative embodiment of the present invention, the heat-generating surface of external heating source 30 is curved to match the profile of the fuser member 20. According to one practice, the substrate 31 forms a long arc, and the resistive ceramic-containing coating 32 is distributed over a surface of the arc facing the fuser member 20. The external heating source 30 is disposed adjacent the fuser member to supply thermal energy to at least a portion of the periphery of the fuser member 20. The shape of the heating source 30 provides uniform heating of the fuser member surface 22, since the air gap 34 formed between the coating 32 and the fuser member surface 22 is substantially uniform throughout. Particularly, the external heating source 30 uniformly can heat an entire lengthwise or diametrical (e.g. half-circle) dimension of the fuser member 20. In addition, the fuser member surface 22 is heated by the source 30 for a time sufficient to heat the surface to a desired temperature, thereby promoting proper fusion of the image to the support sheet. This contrasts with conventional type external heaters where heat is applied to a limited location on the surface of the fuser member. As illustrated in FIG. 2 of the present invention, heat is radiated through an arc of greater than about 90 degrees, and can extend to about 180 degrees or even greater. Thus, at least about twenty-five percent of the fuser member surface is constantly exposed to heat from the external heating source 30.

Figure 3:
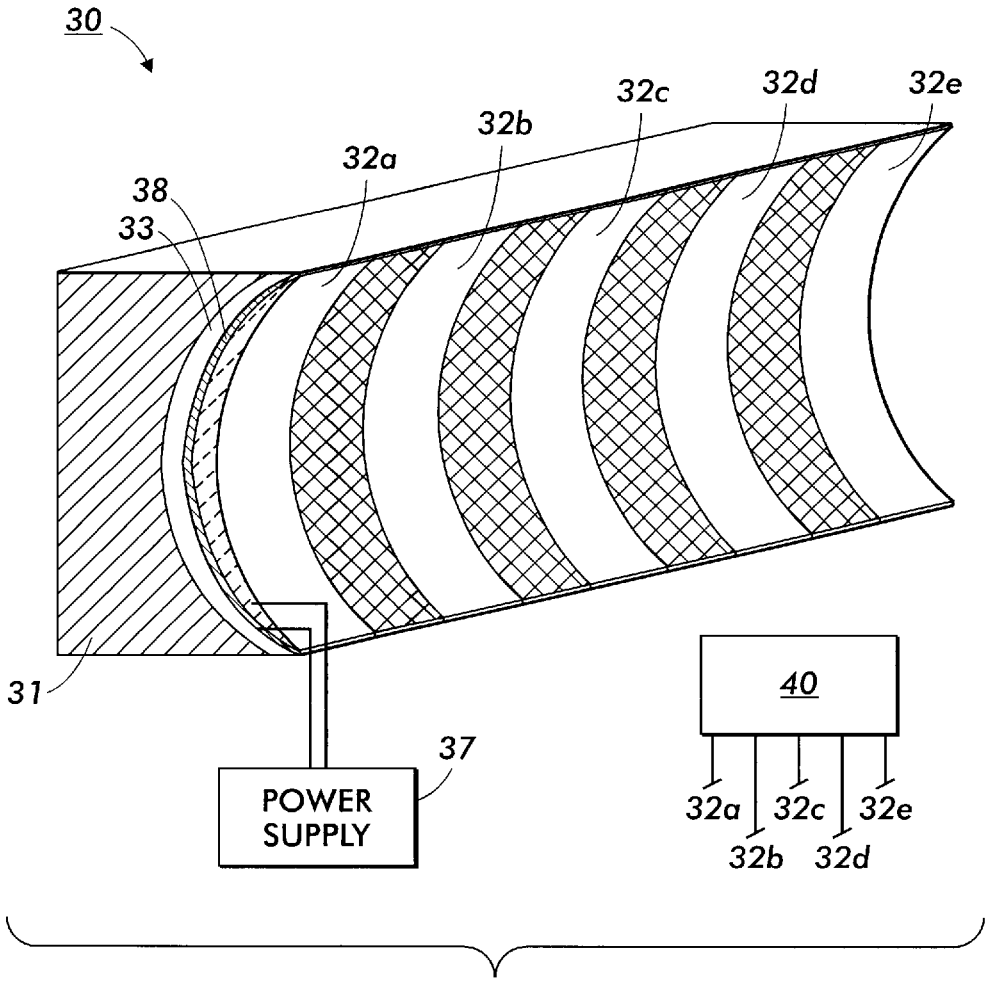
FIG. 3 is a perspective view of an external heating source of the present invention in which a ceramic coating is applied in the form of circumferential strips on a surface of the external heating source.

Referring to FIG. 3, the ceramic-containing coating 32 may be applied to the substrate 31 in the form of circumferential strips 32*a*, 32*b*, 32*c*, 32*d*, and 32*e*. Each strip corresponds to a particular location on the fuser member surface 22, and each strip may be individually controlled by a controller 40 of the image forming system to radiate a desired amount of heat energy to the corresponding location on the fuser member surface. The controller monitors and adjusts the amount of power supplied to each strip to regulate the amount of heat energy generated by each strip. As illustrated in FIG. 3, the substrate 31 includes a base coating of a dielectric material 33, an intermediate layer of conductive material 38, with the strips disposed thereon to form a heat-generating surface. The ceramic strips can be separated by dielectric material 33 disposed between the strips. The conductive layer conducts current from the power supply 37 to the ceramic-containing strips. In addition to providing individually controlled areas, the embodiment illustrated in FIG. 3 also reduces the amount of ceramic material employed, thus reducing the overall cost of the external heating source 30.

Figure 4:
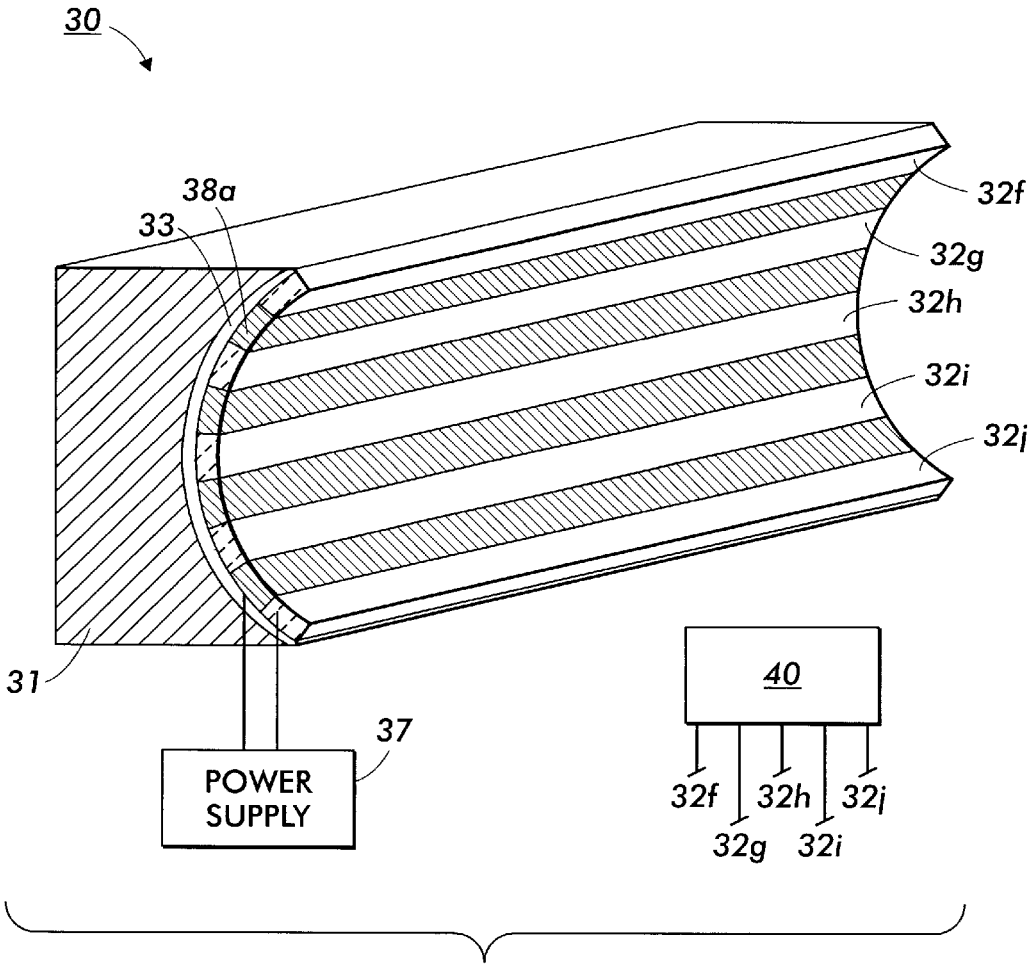
FIG. 4 is a perspective view of an external heating source of the present invention in which a ceramic coating is applied in the form of longitudinal strips on a surface of the external heating source.

Alternatively, as illustrated in FIG. 4, the ceramic-containing coating may be applied as longitudinal strips 32*f*, 32*g*, 32*h*, 32*i*, and 32*j* across a surface of the external heating source 30. Each strip extends along the lengthwise dimension of the external heating source 30. The conductive copper layer 38*a* is included between the dielectric layer 33 and each of the ceramic-containing strips.

Figure 5:
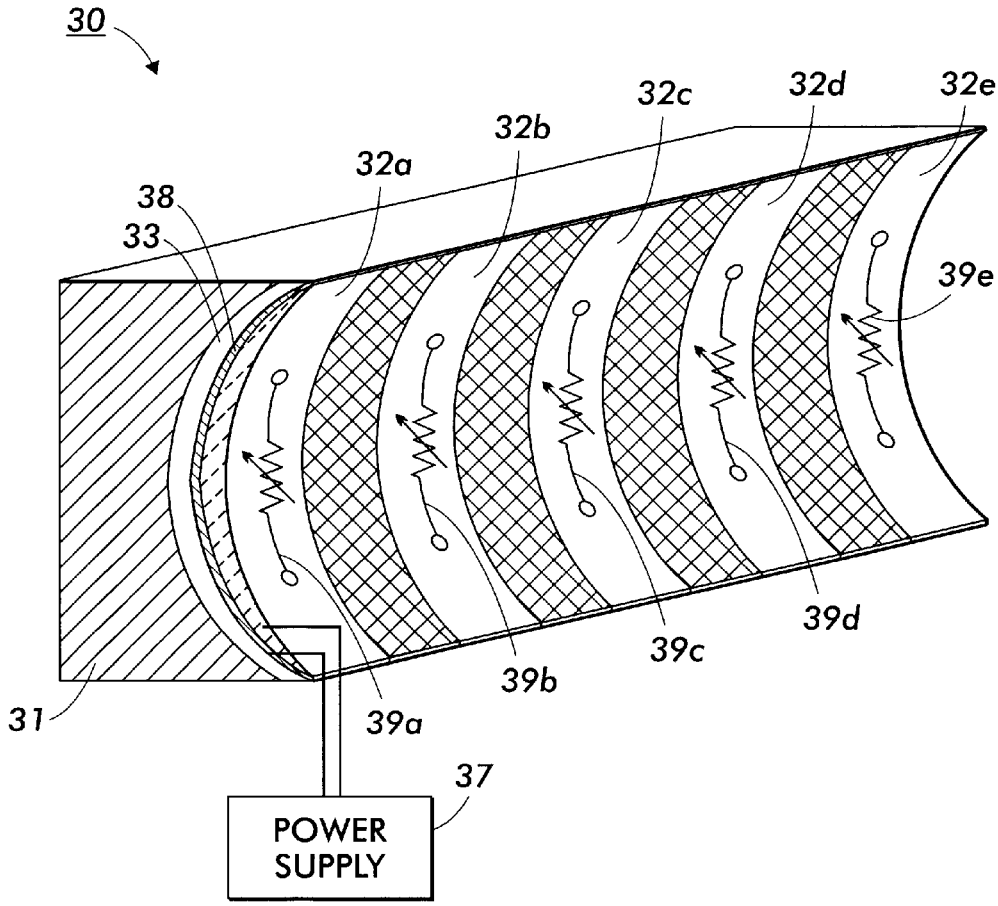
FIG. 5 is a perspective view of an external heating source of the present invention including temperature sensors for controlling temperature on a fuser member surface.

FIG. 5 illustrates another embodiment of the heat source 30 of the present invention. The heat source 30 includes a substrate 31 having a layer of dielectric material 33 disposed thereon. A layer of conductive material 38, such as copper, is then formed on the dielectric material 33. A plurality of ceramic strips 32*a*, 32*b*, 32*c*, 32*d*, and 32*e*, as illustrated in FIG. 3, are employed and can include one or more temperature sensors, illustrated as thermistors 39*a*, 39*b*, 39*c*, 39*d*, and 39*e*. A thermistor (i.e. a thermally sensitive resistor) is a temperature-sensitive semiconductor device capable of generating heat when provided with a current, and having a resistance that varies with temperature such that resistance decreases as temperature increases. Consequently, as the temperature increases, the resistance in the ceramic-containing coating decreases, and the external heating source 30 generates less heat. Conversely, a drop in the temperature increases the resistance of the thermistor, and thus the resistance of the ceramic-containing coating, leading to an increase in the amount of heat generated by the external heating source. The thermistors 39*a*, 39*b*, 39*c*, 39*d*, 39*e* form a feedback control loop for maintaining an optimum operational temperature on the surface 22 of the fuser member 20. As the temperature of the fuser member surface increases, it radiates heat back to the external heating source 30. The feedback control loop is adapted to generate heat only when necessary to increase the temperature of the fuser member surface 22. When a difference exists between a desired temperature (the preferred operating temperature) and an actual temperature, each thermistor activates a power flow to the corresponding ceramic strip in order to achieve and maintain the desired temperature. The feedback loop forms a proportional (P) control system having a high gain value. Thus, deviation from an optimum temperature triggers a fast response from the thermistors to restore the optimum temperature.

The proportional feedback loop using thermistors presents a significant improvement over the prior art. Prior heating systems for fuser members implemented complicated and expensive equipment to achieve and maintain a specific temperature on the fuser member surface. Generally, a $2^{nd}$ order control system was implemented at the fuser member surface. The control system necessitated proportional-derivative control (PD) to provide an accurate and rapid response. Prior art systems included sensors for monitoring the temperature on the surface of the fuser members and complex components of a feedback circuit for providing an input control temperature and for controlling the output of the heating system to produce a desired temperature. A PD control is associated with a difference between a desired temperature and an actual measured temperature of the fuser member, as well as the time derivative of the difference. The present invention simplifies the feedback loop, while concomitantly producing highly accurate and rapid results. The present invention eliminates the need for the expensive and complex temperature control equipment currently used in fuser systems.

A significant advantage of the present invention is the ability to control temperature at individual points along the fuser member surface. Thus, in regions where there are no thermal losses, surplus heat is not applied to the fuser member. However, in regions where the temperature drops due to thermal losses, such as conduction through paper contact, additional heat is generated and directed to these regions to maintain a constant temperature. As a result, a uniform and specific temperature is maintained throughout the surface of the fuser roll, promoting proper fusion of a toned image to a support sheet and uniformity in the final printed image. In addition, the fusing system of the present invention minimizes potential heat related damage, such as fires or scorching of the support sheet, resulting from excessive heat being supplied to the fuser member, or an excessive temperature at one location on the fuser member surface. Furthermore, the ability to control the temperature at individual points along the fuser member surface results in energy savings, as the invention reduces the generation of unnecessary surplus heat.

Efficiency in terms of energy usage is realized in a number of other ways as well. A primary benefit is that the external heating source 30 only directs heat to the surface 22 of the fuser member 20, which limits energy consumption and energy losses. Since only the surface of the fuser member contacts the toner particles in the toned image, it is only necessary to heat this portion of the fuser member. Energy is not required to transfer through the bulk of the fuser member 20, as with internal heat sources. Substantial energy losses are generated in fuser members heated via internal heat sources, since the heat must be transmitted through materials that are generally poor conductors of heat. Also, as the heat-generating surface of the external heating source is spread over a larger surface area and is located in close proximity to the fuser member surface, the present invention efficiently and uniformly provides thermal energy to a specified portion of the fuser member surface. Furthermore, the external heating source of the present invention achieves a rapid warm-up time, which ensures rapid heating of the fuser member surface. Overall, less energy and time is required to attain a suitable fusing temperature on the surface of the fuser member.

The present invention provides still further benefits to an image forming system. As discussed, the heating source of the present invention only heats the surface of the fuser member. Less heat is necessary for the fusing process, allowing the heating source to operate at a lower temperature overall. As the elastomer or polymer material that comprises the fuser member 20 is weakened by heat transmission or exposure to high temperatures, a lower operating temperature and a reduction in heat energy significantly increases the lifetime of the fuser member and the fusing system as a whole.

In the present invention, print quality is also improved, due to decreased degradation of the materials that comprise the fuser member. In addition, the elastomer comprising a fuser member can be optimized for mechanical properties, without consideration of thermal stability or other thermal properties. For example, in fuser members having an internal heating source or an external heating source that directs a large amount of heat to a limited location of the fuser member, the elastomer material must be thermally stable to withstand high temperatures. In a fusing system that implements the external heating member of the present invention, a lower grade elastomer may be used to form the fuser member. This also reduces the overall cost of the fuser member.

Print quality is also improved due to a reduction in toner offset when implementing the external heating source of the present invention. Replacement of an internal heating source for a fusing member with the external heating source of the present invention allows a reduction in the size of the fuser member. When the fuser member is a fusing or other cylindrical roll, a smaller size provides better release properties, resulting in fewer irregularities and stray marks in the final printed image.

Moreover, a reduction in the size of the fuser member affords further savings in terms of both cost and energy. Additional cost savings are realized in the construction of the fusing system of the present invention. Using an external heating source as illustrated, the core of a fuser member core of the fuser member can be manufactured from a non-metallic material, such as polymer or composite system. This simplifies the manufacturing process, and further reduces the cost and weight of the fusing system. As discussed, the present invention also eliminates the need for expensive temperature control equipment, by implementing a simplified feedback control system to maintain a uniform temperature on the fuser member surface.

As illustrated, the external heating source 30 for fuser members provides significant advantages over the prior art, including enhanced print quality, increased lifetime of a fusing system, simplicity, energy efficiency and cost savings.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. In an image forming system, a fusing system for fusing a toned image to a support sheet, comprising a fuser member and an external heating source for supplying thermal radiation to heat a surface of the fuser member, wherein said external heating source includes a substrate and an outer ceramic-containing coating.

2. The fusing system of claim 1, wherein an outer surface of the external heating source is complementary in shape to a surface of the fuser member.

3. The fusing system of claim 1, wherein the fuser member comprises a cylindrical roll and the external heating source forms an arc extending along a selected peripheral portion of the cylindrical roll.

4. The fusing system of claim 1, wherein the ceramic-containing coating comprises a plurality of ceramic-containing strips.

5. The fusing system of claim 4, further comprising one or more temperature sensors coupled to one or more of said plurality of ceramic strips.

6. The fusing system of claim 5, wherein said temperature sensor forms a feedback control loop for maintaining a specific temperature on surface of the fuser member.

7. The fusing system of claim 1, wherein the fuser member comprises a polymer substrate.

8. The fusing system of claim 1, further comprising a power source coupled to the external heating source for providing power thereto to heat the ceramic-containing coating.

9. The fusing system of claim 8, wherein the external heating source further comprises a conducting layer disposed between the substrate and the ceramic-containing coating for directing current to the ceramic-containing coating.

10. The fusing system of claim 1, wherein the ceramic-containing coating comprises a transition metal oxide.

11. The fusing system of claim 1, wherein the external heating source further comprises an intermediate dielectric layer disposed between the substrate and the ceramic-containing coating.

12. The fusing system of claim 11, wherein the external heating source further comprises a conducting layer disposed between the dielectric layer and the ceramic-containing coating.

13. The fusing system of claim 1, further comprising a plurality of temperature sensors coupled to the ceramic-containing coating in a plurality of locations for individually controlling the temperature in each of said plurality of locations.

14. An image forming system for forming images on a recording medium, comprising:

an imaging member adapted to receive an electrostatic latent image thereon, a development station for applying a toner to said imaging member to develop said electrostatic latent image to form a developed image on said imaging member;

a transfer component to transfer the developed image from said imaging member to the recording medium; and a fusing assembly for fusing the developed image to a surface of said recording medium, said assembly including a fuser member in thermal communication with an external heating source having a ceramic-containing coating, wherein said external heating source is adapted to generate radiant thermal energy for heating the fuser member.

15. The image forming system of claim 14, wherein the external heating source further comprising one or more temperature sensors coupled to said ceramic-containing coating.

16. The fusing system of claim 15, wherein said temperature sensor is coupled to a controller to form a feedback control loop for maintaining a specific temperature on the surface of the fuser member.

17. The image forming system of claim 14, wherein the ceramic-containing coating comprises a transition metal oxide.

18. The fusing system of claim 14, wherein the external heating source further comprises a dielectric layer disposed beneath the ceramic-containing layer, and a conducting layer disposed between the dielectric layer and the ceramic-containing coating for directing current to the ceramic coating.

19. In an image forming system, a method for manufacturing an external heat source for supplying thermal radiation to heat a surface of a fuser member, comprising the steps of:

providing a substrate having a surface that is complementary to an outer surface of the fuser member;

applying a dielectric coating to said surface of said substrate; and applying an outer ceramic-containing coating to the dielectric coating, wherein the outer ceramic-containing coating generates heat and radiates the heat to the outer surface of the fuser member via an air gap.

20. The method of claim 19, further comprising a step of applying a conductive coating to said dielectric coating.

* * * * *